United States Patent [19]

Nikitits

[11] 4,223,945

[45] Sep. 23, 1980

[54] COLLAPSIBLE TABLE AND SEAT ASSEMBLY

[75] Inventor: Edwin Nikitits, Lachine, Canada

[73] Assignee: Franklyn M. Marcus, Montreal, Canada

[21] Appl. No.: 895,262

[22] Filed: Apr. 10, 1978

[51] Int. Cl.[3] ..... A47B 39/00; A47B 3/00

[52] U.S. Cl. ..... 297/159; 108/34; 108/112

[58] Field of Search ..... 108/113, 112, 34, 35, 108/36, 115; D6/45, 43, 44; 297/159; 16/DIG. 13

[56] References Cited

U.S. PATENT DOCUMENTS

| | | | |
|---|---|---|---|
| D. 171,625 | 3/1954 | Wahl | 297/159 X |
| 1,956,483 | 4/1934 | Alpers | 297/159 X |
| 2,457,411 | 12/1948 | Steinberger | 108/34 X |
| 2,522,642 | 9/1950 | Schmidt | 108/36 X |
| 2,524,198 | 10/1950 | La Rue | 108/34 X |
| 2,647,562 | 8/1953 | Hoffar | 297/159 X |
| 3,220,362 | 11/1965 | Downes | 108/112 |
| 3,445,052 | 5/1969 | Lewallen | 16/DIG. 13 |
| 3,994,527 | 11/1976 | Nikitits | 297/159 |
| 4,101,164 | 7/1978 | Nikitits | 297/159 |

FOREIGN PATENT DOCUMENTS

| | | | |
|---|---|---|---|
| 2703168 | 1/1978 | Fed. Rep. of Germany | 108/113 |
| 377527 | 7/1932 | United Kingdom | 108/112 |

*Primary Examiner*—James T. McCall

*Attorney, Agent, or Firm*—Hubbell, Cohen, Stiefel & Gross

[57] ABSTRACT

A collapsible combined table and seat assembly wherein the table top, its legs and the associated seats are all defined by plastic plate-like members that are pivotally joined to one another for folding and unfolding. Pivots are defined either by integral fold lines in plastic or by mechanical hinges. The seats are formed of four pivotally connected plate-like members defining a three sided vertical wall structure supporting a plate-like top which are mutually pivotally connected and releasably positioned in the operative position.

38 Claims, 23 Drawing Figures

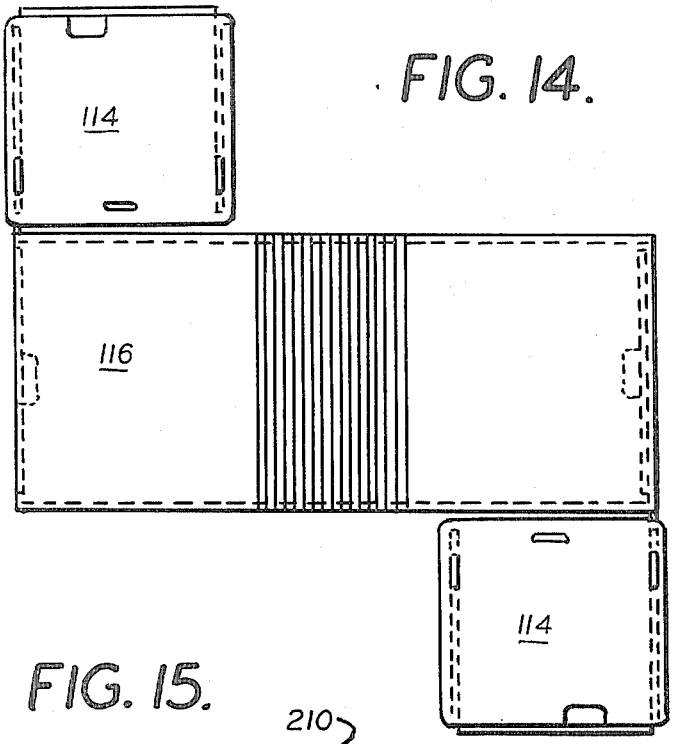
FIG. 14.
FIG. 15.
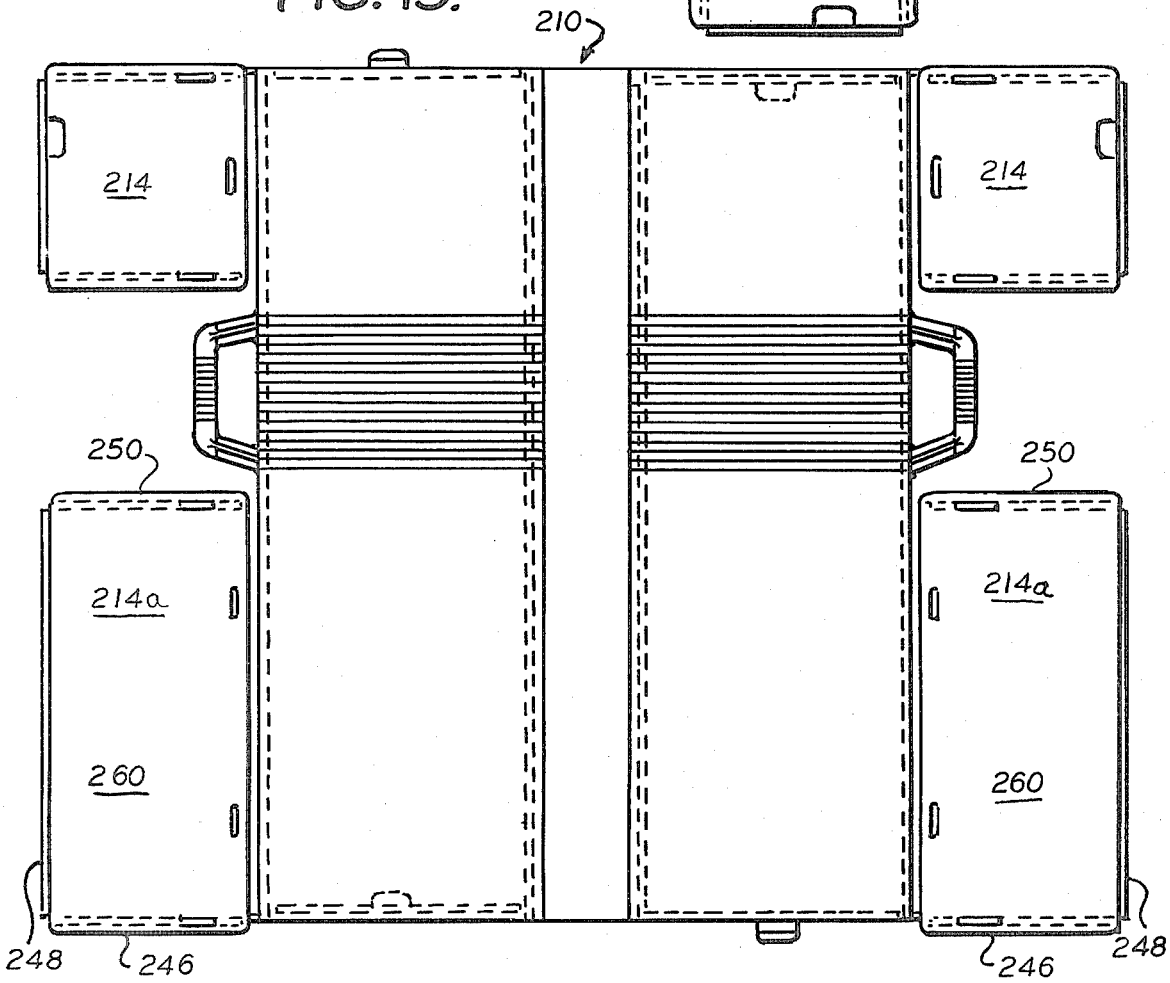

COLLAPSIBLE TABLE AND SEAT ASSEMBLY

BACKGROUND OF THE INVENTION

1. Field of the Invention

This invention relates to a combined folding table and seat assembly and particularly to a combined folding table and seat assembly that is collapsible into a self-contained carrying case comprised of the table top. Most particularly, this invention relates to a combined folding table and seat assembly which is collapsible into a case comprised of a folding table top, which assembly, when folded, is readily portable and storable in the trunk of an automobile, a closet or the like.

2. Statement of The Prior Art

As the society has become increasingly mobile through the greatly expanded use of the automobile, more and more families seek to picnic along the side of a road or in a secluded spot. While, often times, prepared picnic facilities are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which use unstructured classroom arrangements. In such arrangements, it is often desirable to clear a room entirely of tables and chairs for certain activities. To remove standard desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seat assembly is disclosed. This Bassford assembly was, by virtue of the nature of the collapsing movements of the various components, relatively large in its collapsed condition. Moreover, there are a number of detachable elements which must be disconnected before collapse is effected and must be connected to effect opening. In U.S. Pat. No. 1,514,418 granted to J. N. Battenfield on Nov. 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In Peterson's U.S. Pat. No. 1,641,010, a collapsible table and chair or seat arrangement is disclosed. This arrangement, however, has a multiplicity of detached parts which must be joined to effect assembly. This is inconvenient and time consuming. Moreover, because of the number of separate joints in the Peterson device, it is difficult to make such a device rigid without utilizing heavy, costly parts. Similarly, in the patent granted to L. Wing on June 11, 1929, U.S. Pat. No. 1,716,612, a collapsible combined table and seat is disclosed. However, the nature of the support of the table on the seats is such as to render the structure somewhat unstable. In Soltesz U.S. Pat. No. Re. 18,207 granted Sept. 22, 1931, still another collapsible combined table and seat is disclosed. This structure requires complex toggle linkages and numerous separate operations for assemblying and disassemblying the combined assembly. Also, the structure precludes access from the sides of the seat, thereby rendering it inconvenient in use. On Oct. 8, 1940, a patent was granted to F. Weber, U.S. Pat. No. 2,217,576, which patent is directed to a collapsible folding table and seat. This device requires complex sliding linkages which would prove to be heavy and costly. In U.S. Pat. No. 2,558,465 granted to P. M. Seymour on June 26, 1951, a combined table and bench assembly is disclosed. This table and bench assembly relies heavily on chainlike tension members for stiffness which members are heavy. Also, the nature of the assembly is such that the table in the Seymour assembly will not be as stable as is required for normal dining use. Likewise, in U.S. Pat. No. 2,647,562 granted to C. F. Hoffar on Aug. 4, 1953, a combined collapsible table and seat assembly is disclosed. However, the Hoffar structure also includes complex linkages and requires a large number of independent operations for opening and closing the assembly. In addition, the Hoffar assembly includes linkages which preclude access from the sides of the benchlike seats and thereby render the assembly difficult to use. Post U.S. Pat. No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Pat. Nos. 1,054,743 and 1,092,230. French Pat. No. 988,168 relies on a flaccid seat which is not wholly rigid in use and the support for the table top is a parallelogram which is inherently less stable than triangular supports. In U.S. Pat. No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Pat. No. 3,256,037 granted to J. Giambaldo on June 14, 1966, yet another form of combined table and seat is disclosed. This structure is inconveniently heavy and the linkage employed therein will not yield as rigid a structure as is required.

On Nov. 30, 1976, U.S. Pat. No. 3,994,527 was granted to Edwin Nikitits et al and assigned to the assignee hereof, and on Oct. 4, 1977, U.S. Pat. No. 4,052,100 was granted to Edwin Nikitits et al, and assigned to the assignee hereof. Both of these patents disclose combined collapsible table and seat assemblies incorporating bench-like structures on both sides of a foldable table top which bench-like structures are themselves collapsible and are connected by mechanical linkages to the table top for movement thereunder to collapse the table. Each of these structures represents advances over the prior art cited therein or previously known by applicant but each structure incorporates a considerable amount of metal or other formed material which tends to increase both price and weight of the structures. This is likewise true of U.S. patent application Ser. No. 638,327 filed by Edwin Nikitits et al on May 5, 1976 and assigned to the assignee hereof.

Recently U.S. Pat. No. 4,070,057 filed by William C. Jones and assigned to the assignee hereof was issued. This patent, and U.S. patent application Ser. No. 842,573 filed on Oct. 17, 1977 by William C. Jones, and assigned to the assignee hereof, represent still other approaches to the construction of combined collapsible tables and seats. These two Jones constructions, like the above referred to structures of Nikitits et al, require substantial castings or injection moldings and the inclusion of a number of metal parts all of which contribute either to the cost of the assembly, its weight or both. Thus, while these Jones structures also represent a significant advance over the prior art, they do not completely achieve the ultimate desiderata of a lightweight, unitary and inexpensive structure to define combined collapsible tables and seats. This is likewise true of the prior art cited in said Nikitits et al applications and patents and said Jones application and patent, all of which have been considered and are not believed pertinent to the present invention.

From the review of the prior art above presented, it will be seen that there have been numerous attempts over the years to produce a lightweight, inexpensive, easily folded and unfolded combined collapsible table and seats. However, each prior art proposal has fallen somewhat short of the mark. As a result, there has been to date no significant commerical success for any of the prior art devices known to applicant.

BRIEF DESCRIPTION OF THE DRAWINGS

In the drawings:

FIG. 14 is a top plan view of yet another modification of this invention;

FIG. 15 is a top plan view of still a further modified form of the present invention;

FIG. 23 is a view similar to FIG. 1 showing a modified assembly useful as a bridge table or the like.

DETAILED DESCRIPTION OF PREFERRED EMBODIMENTS

Figure 1:
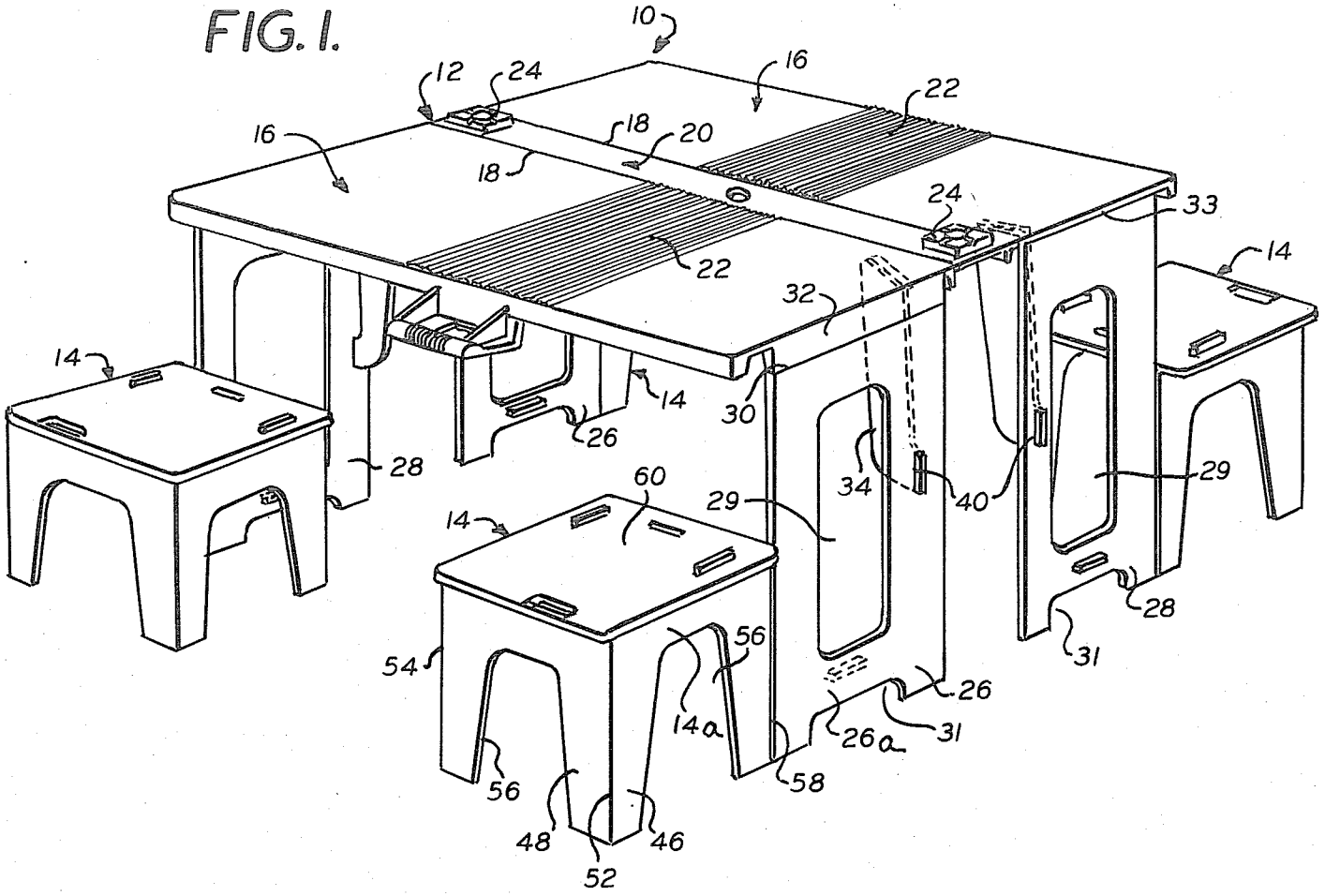
FIG. 1 is a perspective view of a combined collapsible table and seat embodying the present invention.
Figure 2:
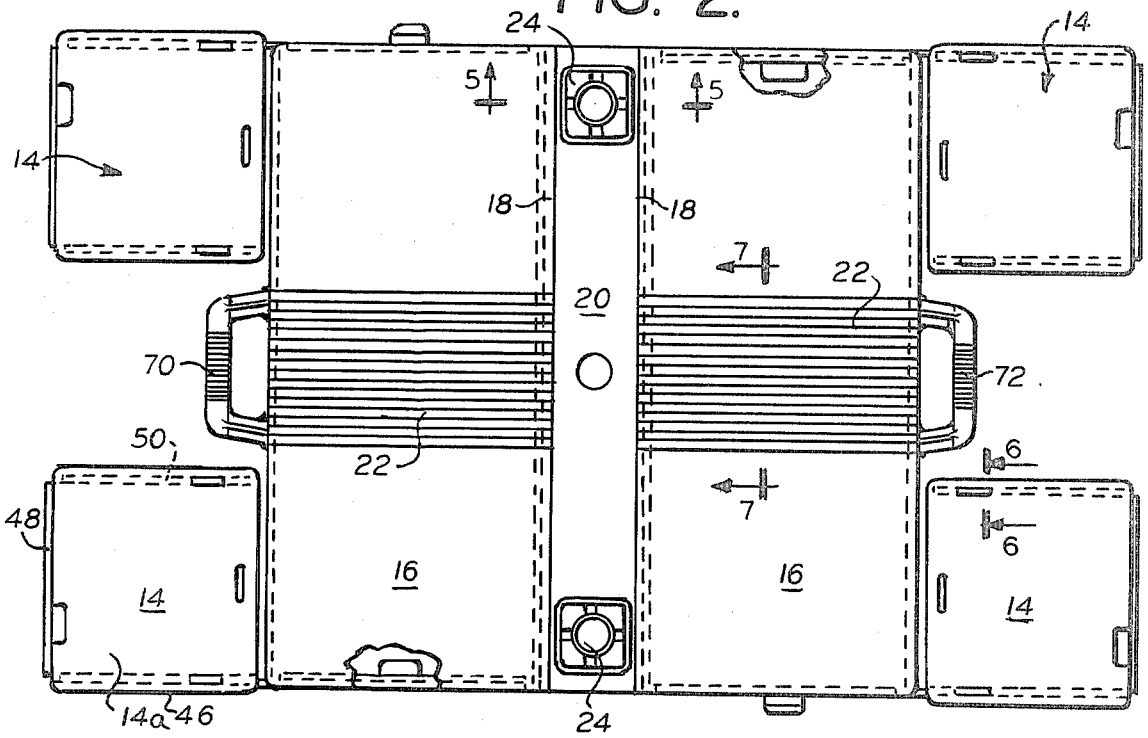
FIG. 2 is a top plan view thereof.
Figure 3:
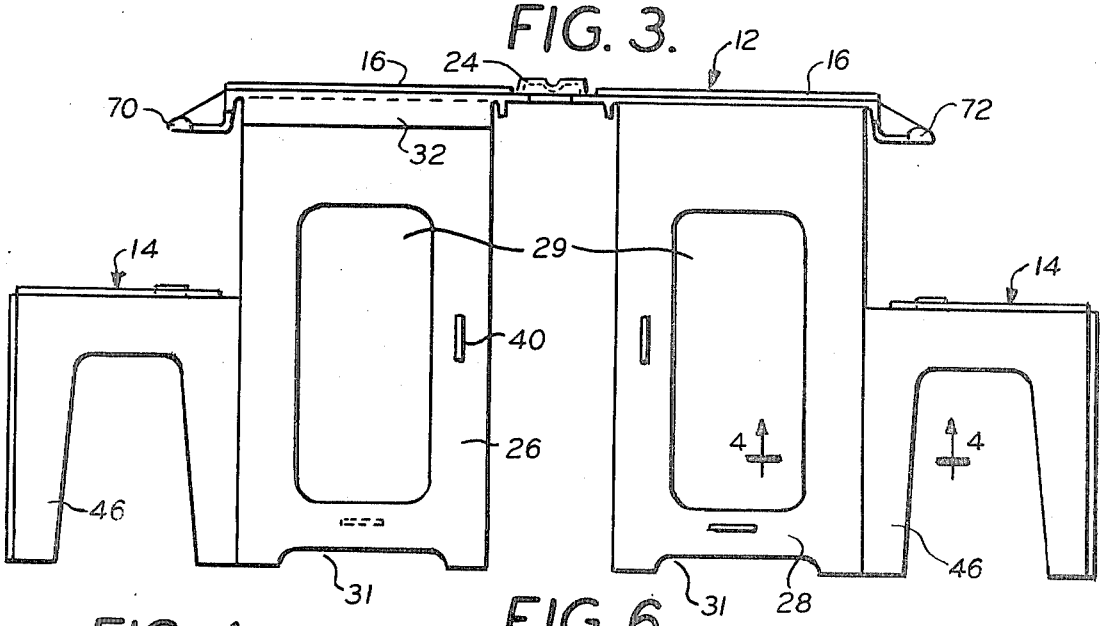
FIG. 3 is a side elevational view thereof.
Figure 4:
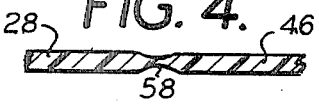
FIG. 4 is a sectional view taken along the line 4—4 of FIG. 3.
Figure 6:
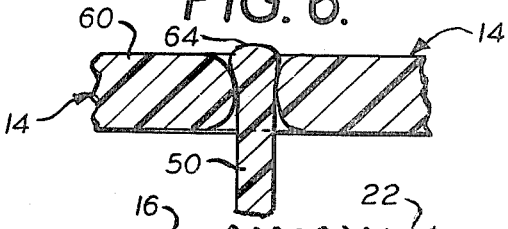
FIG. 6 is a sectional view taken along the line 6—6 of FIG. 2.
Figure 5:
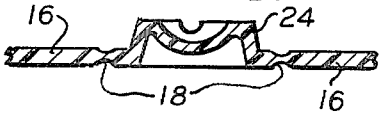
FIG. 5 is a sectional view taken along the line 5—5 of FIG. 2.
Figure 7:
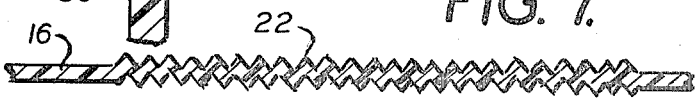
FIG. 7 is a sectional view taken along the line 7—7 of FIG. 2.

Referring now to the drawings in detail and particularly to FIGS. 1 through 8 thereof, a collapsible combined table and seat assembly 10 embodying the present invention is illustrated in its unfolded or usable condition. The assembly 10 comprises a collapsible table 12 and four collapsible seats 14, two adjacent each end of the table 12. Table 12 comprises two relatively pivotally movable table top portions 16 which are pivotally connected adjacent the center of the table by two parallel transversely extending pivots 18 defining a central spine or rib 20. The table top portion 16 and rib 20 may be made of any suitable material such as, for example, wood, sheet metal such as sheet aluminum, fiber board and press board, or fiberglass reinforced plastic. Alternatively, the table top may be made of lightweight composite structures such as honeycomb cord plastic structures or it may be made of foam injection molded materials such as foam injection molded polystyrene, polycarbonate, polyvinylchloride, low molecular weight polyethylene, polypropylene, or other similar materials capable of being employed for structural foam injection molding. Such materials and the process of foam injection molding are described in, inter alia, U.S. Pat. Nos. 3,058,161; 3,211,605; 3,268,636; 3,348,691; 3,436,446; 3,599,290; 3,674,401 and 3,746,492, the contents of which are hereby incorporated by reference in their entireties. Preferably, the table top portion 16 and rib 20 are integrally formed from a plastic material capable of defining an integral hinge through a thinned down linear section. Numerous plastic materials are well known for this purpose and among those best known is isotactic polypropylene. When such a material is employed, then the table top comprised of the portion 16 and rib 20 may be formed integrally either by molding or by stamping from a sheet of such material, the stamping being employed not only to define the outer perimeter of the table top but also the thinned down section of the plastic material in the vicinity of the fold lines or pivots 18 at both sides of the central rib or spine 20. As shown, the table top is injection molded and incorporates therein longitudinally extending ribs 22 to provide additional stiffness for the table top. Of course the ribs 22 may be placed at the bottom surface of the table rather than at the top as shown. Likewise, if injection molding is employed, additional appurtenances may be molded into the table top such as the ashtray structures 24 in the central spine or rib 20. As will be discussed in greater detail hereinafter, additional reinforcement in the form of separate ribs affixed to the table top, generally to the bottom surface thereof, may be employed in lieu of the integrally formed ribs 22.

As shown in FIG. 1, integrally formed with the table top are four plate-like legs 26 and 28. To reduce leg weight without sacrificing stiffness, each plate like leg has a substantial amount of material omitted or removed to define central aperture 29 as well as a bottom cutout 31. Each of the legs 26 and 28 is pivotally connected to the bottom of the table top adjacent the sides thereof.

Each leg 26 is pivotally connected to the table top by a suitable pivotal connection 30 spaced downwardly from the table top a sufficient distance to accomodate the collapsed structure that is folded with it during collapse as will be discussed hereinafter. Assuming the entire structure is made integrally of one piece of plastic, then the pivot line 30 defines an integral hinge formed either by molding or by stamping. If, alternatively, the legs 26 are pivotally connected to the table by a mechanical hinge, then the table may be provided with a skirt 32 extending downwardly the necessary distance, or the legs 26 may have a suitable fold line spaced from the tops thereof. The legs 28, on the other hand, are preferably pivotally connected, either by integral hinges or external mechanical hinges right adjacent the bottom of the table top as along the line 33. The legs 26 and 28 are pivotally movable between the dependent operative position in which they are shown in FIG. 1 and to and from an inoperative, folded or collapsed position in which they underlie the table top portions 16 as will be described in greater detail hereinafter.

Figures 8, 9:
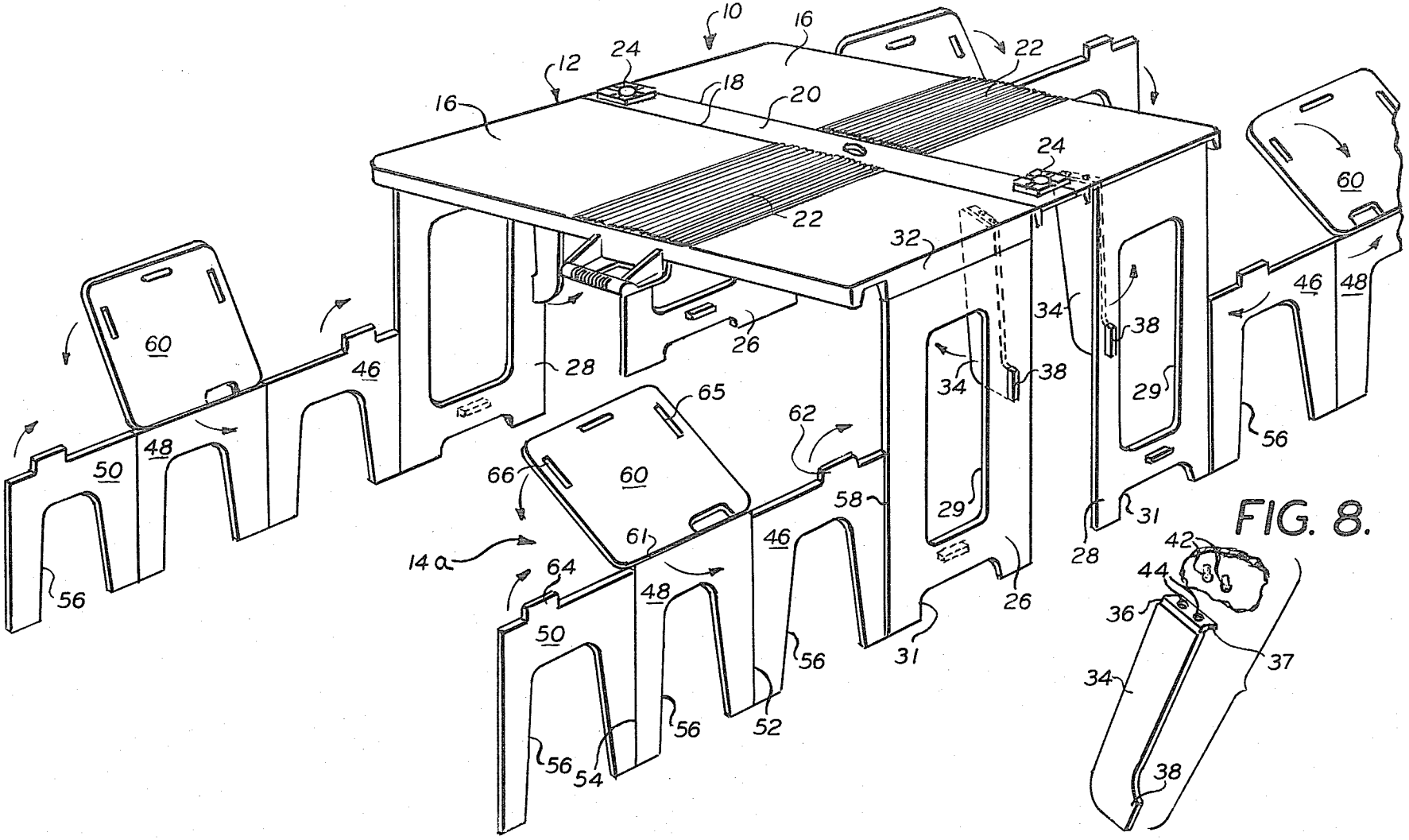
FIG. 8 is a fragmentary perspective view detailing the leg braces for the table.
FIG. 9 is a perspective view of the table of FIG. 1 in partially knocked-down condition.

When in the unfolded or extended dependent position of FIG. 1, suitable braces 34 extending between the legs 26 and 28 and the table top portions 16 are connected for holding the legs in the illustrated dependent position. While any form of brace may be employed, the presently preferred brace is shown in FIG. 8 and is a plastic, plate-like member 34 having an integral hinge 36 adjacent the top to define a mounting lip 37. Hinge 36 permits the main portion of the brace to swing from a position underlying its associated table top portion 16 to a vertical position in which an outwardly extending hooked end 38 may be fitted into a complementary slot or aperture 40 in its companion leg 26 or 28 to rigidly hold that leg. The brace or bracket 34 may be connected to the bottom of the table top portion 16 by adhesives or heat sealing or the like. As shown, this connection is preferably accomplished by providing the table top with a pair of protruding undercut legs 42 which may be pressed through slightly undersized apertures 44 on the brace mounting lip 37 to hold the brace to the table top bottom. Clearly, mechanical hinges may be employed in the brace in lieu of the integral hinge 36. Alternatively, the brace 34 may not be pivotally connected to table top portion 16 at all. Instead, it may be detachably connected thereto by any suitable means such as clips or other detachable fastening means. Similar detachable fastening means may be employed to connect the braces to their respective legs in place of tabs 38-apertures 40.

Referring now to FIGS. 1 through 9, the four collapsible seats 14 are each pivotally connected to one edge of one of the legs 26 or 28. Thus, with reference to the seat 14*a* adjacent the leg 26*a*, for illustrative purposes, this seat 14*a* is formed of three plate-like members 46, 48 and 50 arranged in a row and pivotally connected to one another along the confronting vertical edge 52 between plates 46 and 48 and confronting vertical edge 54 between plates 48 and 50. Each of these three plates which, as can be seen from FIG. 1, defines a three-sided wall-like structure, are preferably provided with cut outs 56 to reduce their weight. In addition, it will be seen that the plate 46 is pivotally connected at the vertical edge remote from edge 52 to the confronting edge of the leg 26*a* as by a hinge 58. As shown in FIG. 1, all of the hinges 52, 54 and 58 are of the integral hinge type envisioning the plates 46, 48 and 50 and the associated leg 26*a* to be formed integrally of a plastic which admits of the construction of an integral hinge. As will be shown and described in more detail hereinafter, while this is a preferred embodiment, it is not necessary to the operation and desirability of this structure and, if desired, the hinge 58 may be a mechanical hinge joining separately formed seats to their associated legs, or it may be a welded hinge formed by welding plates 46 to legs 26 and 28 after separate fabrication. Pivotally connected to one of the plates 46, 48 and 50 along the upper edge thereof is a seat plate 60. As shown and is presently preferred this seat plate 60 is integrally formed and pivotally connected to the top edge of the wall plate 48 along preferably integrally formed hinge 61. However, and as will be discussed in more detail hereinafter, other arrangements of the four plates 46, 48, 50 and 60 may be devised in which the four plates are all nevertheless pivotally connected to one another to define, when in usable condition, a three-sided vertical support wall with a seat top 60. Suitable means are included for holding the seats 14 in their usable or operative conditions, as shown in FIG. 1. While a variety of releasable connecting means may be employed without departing from this invention, as presently preferred, upwardly extending protruberances 62 and 64 are respectively provided in the upper edges of the plates to which the top 60 is not hinged, that is plates 46 and 50 in FIG. 1, and the top 60 is provided with corresponding slots 65 and 66 to receive said protruberances 62 and 64 when the seat is in usable condition for releasably holding the seat in such condition. Clearly, the vertical extent of the protruberances 62 and 64 is preferably no greater than and perhaps somewhat less than the thickness of the plate forming the seat top 60.

When it is desired to collapse the table and seat assembly 10 of FIG. 1, initially each of the seats is individually collapsed by first pivoting the seat top 60 upwardly to free it from its connections with plates 46 and 50 and the seats are then moved to the positions shown in FIG. 9. Thereafter, the plates forming each of the seats are moved in the directions of the arrows to bring the four plates of the seats into close confronting parallel planar relationship as may be seen in FIG. 10. In achieving this, it may be desirable or even necessary that one or more of the pivotal connections between the four plates forming the seats be a double-hinged connection, somewhat similar to the hinged connection defined by the two pivot lines 18 and the rib 20, in order to accommodate the thickness of the folded plastes therebetween. However, such a detail of construction will be obvious to anyone skilled in the art and has not been included in the drawings as tending to obscure rather than illucidate the true nature of the present invention.

Figure 10:
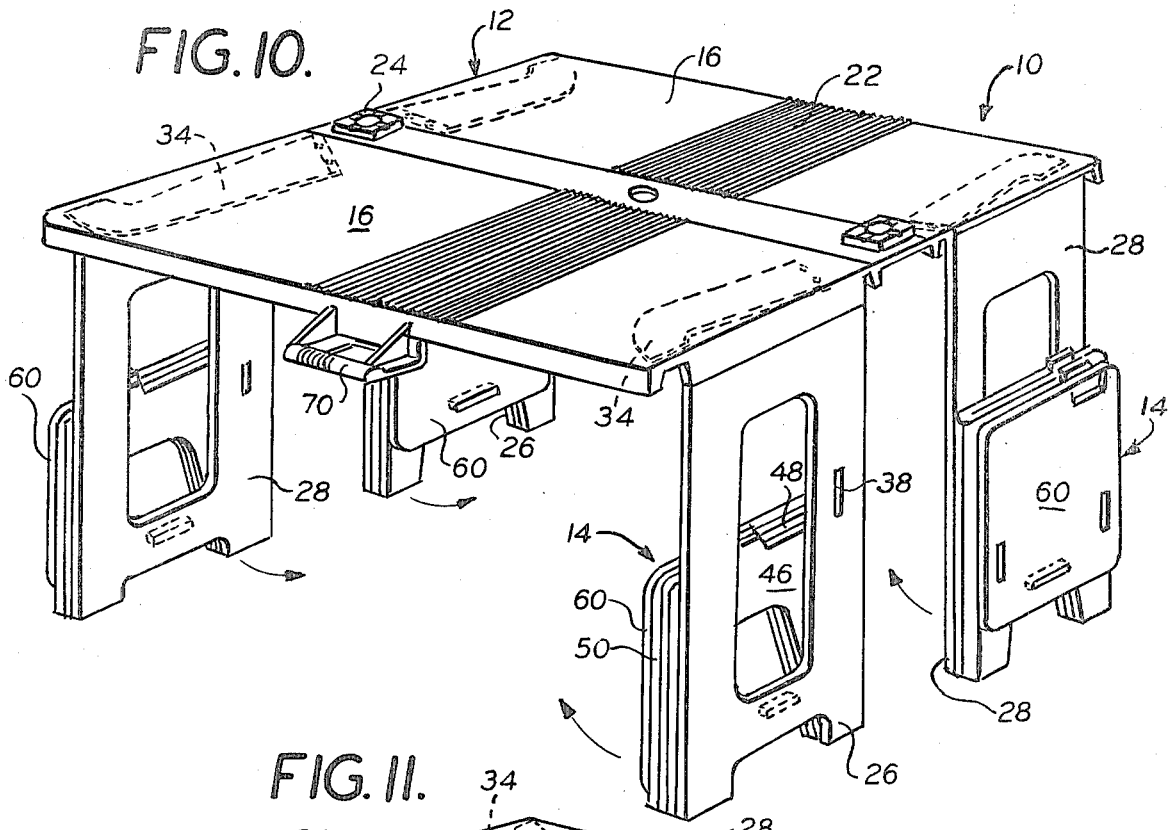
FIG. 10 is a perspective view of the assembly of FIG. 1 in which the seats are fully collapsed.
Figure 11:
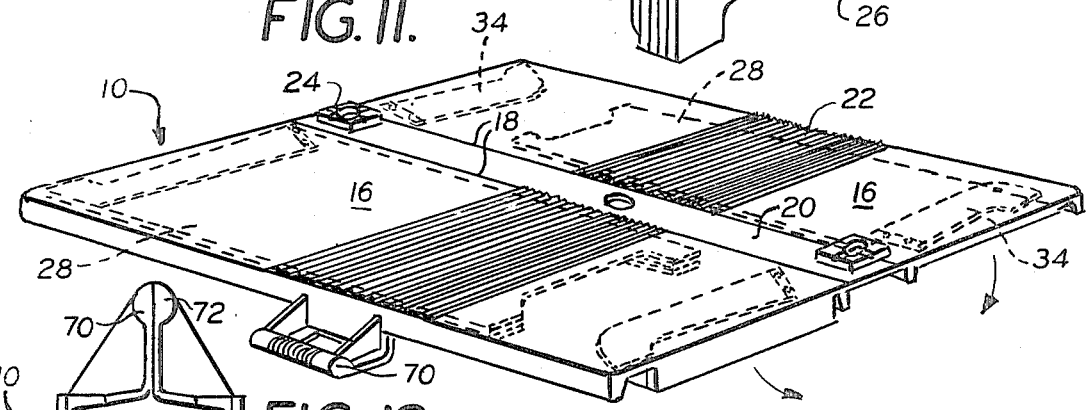
FIG. 11 is a perspective view of the assembly of FIG. 1 in which the legs of the table have been folded under the table top along with the collapsed seats.
Figure 12:
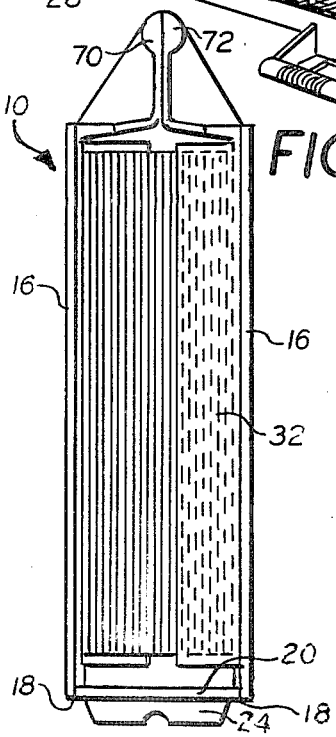
FIG. 12 is an end view showing the assembly of FIG. 1 in fully collapsed condition.

The collapsing of the seats from the FIG. 1 to the FIG. 9 condition and then from the FIG. 9 to the FIG. 10 condition brings the assembly into a condition where the seats 14 are all folded away against the respective legs 26 and 28 but the table 12 itself remains standing intact. In the FIG. 10 condition, each of the braces 34 is now detached from its respective leg 26 or 28 and, assuming a brace structure of the type of FIG. 8, is swung upwardly under the table top portion to which it is pivoted, as shown best in dotted lines in FIG. 10. Once the legs 26 and 28 are freed by disconnection from the brackets 34, they may be pivoted underneath their associated table top portions 16 to the positions shown in FIG. 11. Clearly, when this is done, the legs 28 are folded under the table first and then the legs 26 are folded under the table, the pivots for legs 26 being removed from the table top a sufficient distance to accommodate the thickness of the folded structure, as previously noted. This will bring the collapsed assembly 10 to the condition of FIG. 11 in which the two table top portions 16 may be folded about their adjacent pivot lines or hinges 18 to the condition shown in FIG. 12, the rib or spine 20 being of sufficient width to accommodate all of the folded structure therewithin. Thus collapsed the entire assembly approximates the size of a suitcase. To hold the assembly 10 in the collapsed condition, numerous means may be employed which are well known to anyone skilled in the art. As shown the holding is achieved by a pair of complementary handles 70 and 72 on both ends of the table which fit together and may either be held by some releasable holding means or just be held by the hand of the person carrying the collapsed assembly. In lieu thereof hooks and eyes, various types of luggage catches or any other type of similar releasable holding means may be employed without departing from this invention. Exemplary of such a catch is the one shown in FIGS. 17 to 19 of aforementioned Jones application Ser. No. 842,573, filed Oct. 17, 1977, which is hereby incorporated by reference in its entirety.

Figure 20:
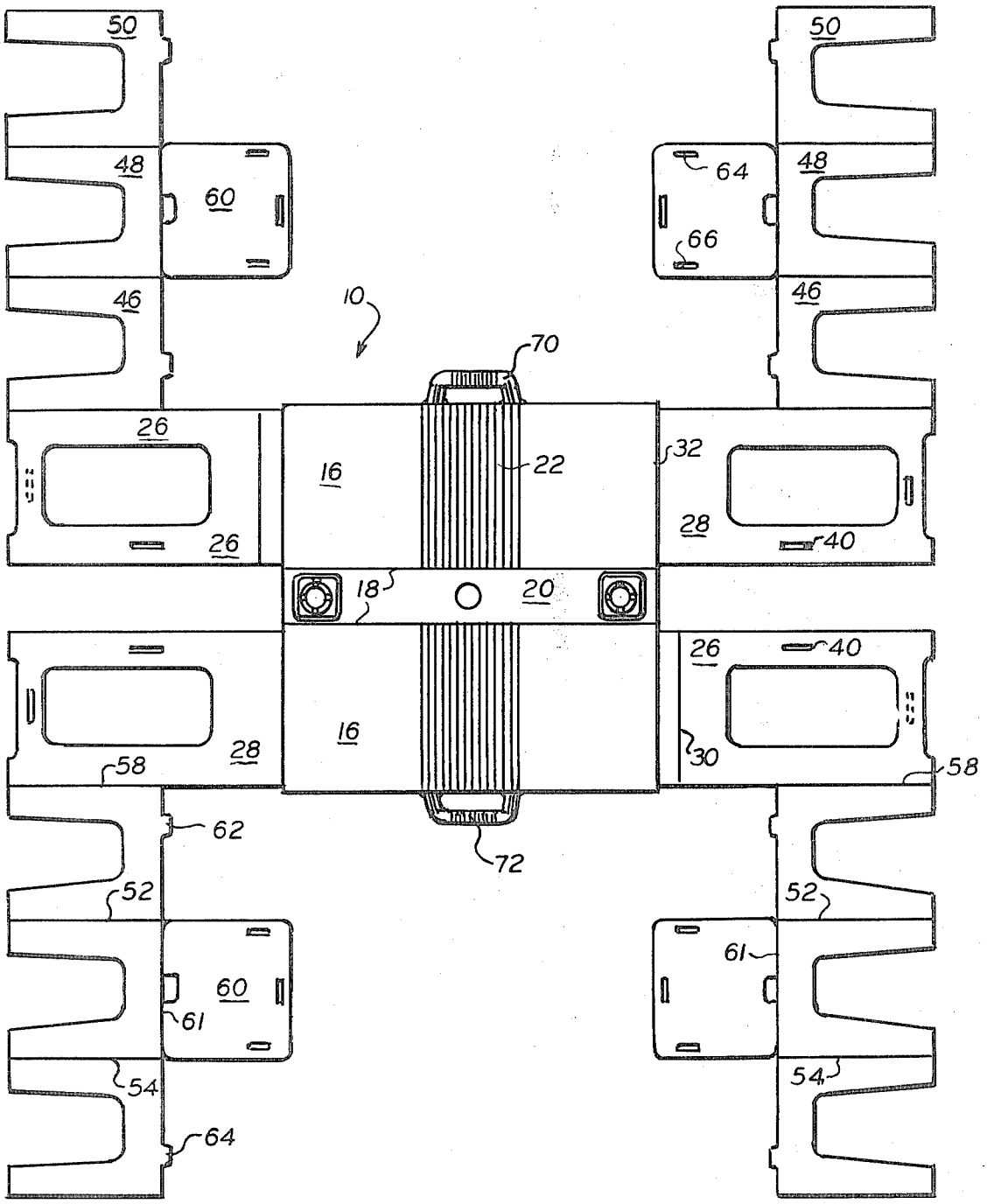
FIG. 20 is a top plan view of the table of FIG. 1 as constructed as a unitary piece.

In addition to the various modifications of the mode of construction already suggested, the present collapsible table and seat assembly 10 may be made all in one piece as may best be seen in FIG. 20. This may be done by injection molding of a material such as polypropylene which yields excellent integral hinges. In such an event, the entire structure is essentially planar during the molding thereof save for the skirts 32 which depend from the top of the table top portions 16 for pivotal connection with the legs 26 so that those legs when folded will accommodate the collapsed or folded members underneath the table. In such an arrangement each of the hinges or fold lines previously described, such as the hinges or fold lines 18, 30, 32, 52, 54, 58 and 61, are all integral hinges formed by thinned down linear portions of the plastic as molded. Such hinges are shown by way of illustration in FIGS. 4 and 5. While most of the integral hinges shown in FIG. 20 may be single acting hinges (FIG. 4), that is hinges that do not permit the two plates connected thereby to move beyond a common plane, it will be clear that the hinges 30 and 32 must be double acting hinges (FIG. 5), since the legs 26 and 28 should be molded in an outstretched condition as shown in FIG. 20 although in use they will not desirably be returned to such position but will only swing between a position underlying their associated table top portion 16 and the dependent operative position shown in FIG. 1. Preferably, a double acting integral hinge is defined by a groove in each surface, whereas a single action hinge is generally provided with a groove in the surface away from which the hinge operates.

Alternative to integrally forming the entire assembly 10 as shown in FIG. 20, various portions of the assembly may be separately formed and then assembled by various assembly techniques. In fact, although not preferred, it is within the scope of this invention that all of the various platelike members hereinbefore described be individually formed and then joined together either by mechanical hinges or by known heat-sealing techniques which will join plates along a line that will serve as a fold line or integral hinge. More preferable, however, is to form the table integrally including the table top portions 16 and the central rib or spine 20 along with the legs 26 and 28 and to form the four seats 14 integrally and then finally to join the seats to their associated legs 26 and 28 along the hinge lines 58 either by using heat-sealing techniques that will define an integral hinge or by employing conventional mechanical hinges. Another alternative mode of construction is to form each of the seats 14 and its associated leg 26 or 28 as one integral unit and then to join the tops of the legs to the bottom of a separately formed table top. The table top may be injection molded or stamped or otherwise fabricated. One advantage to employing the two last described methods is that in lieu of injection molding, which generally requires the construction of relatively costly dies, much or all of the various elements going into the final assembly can be stamped instead of molded, whereby to effect significant production savings. This is to say, for example, assuming the four individual seats were to be separately made from the table and its four legs, each seat could be stamped out of a sheet of plastic material such as polypropylene, whereby to form the peripheral configuration seen in plan view in FIG. 20 and at the same time to form the integral hinges by providing the stamping dies with partially cutting portions that will remove only a part of the material along the fold lines 52, 54 and 61 to define the integral hinges. Of course, such sub-assemblies may be injection molded, if desired. Similar techniques can be employed when the legs are formed integrally with the seats but separately from the table top. Moreover, when this latter mode of construction is employed, then the table top itself may be stamped although, perhaps, separate longitudinal basing may have to be added to enhance stiffness. However, when the legs and seats are formed as a unit as by molding or stamping, then the legs are individually joined to the table top at the positions indicated as by heat-sealing to form an integral hinge or by the use of mechanical hinges. Of course, when stamping is employed, it is doubtful that such appurtenances as the ashtrays 24 could be included.

Various alternate arrangements embodying the basic concepts of the invention as described in connection with the assembly 10 may be employed herein. Thus, with reference to FIG. 13, it is not necessary that the assembly comprise two relatively pivotal table top portions with a pair of seats at each end of the table. The invention may be incorporated in a modified table top assembly 110, having only one table top portion 116 and a pair of seats 114 pivotally mounted on the corresponding edges of the two legs 126 and 128 supporting the table top portion 116. Such an arrangement might be very desirable as in a classroom or the like, especially if the classroom is converted from a large area room such as a gymnasium. Likewise, although not illustrated, a similar arrangement could be made with only one seat 114 merely by halving the width of table top 116. In such an instance the legs 126 and 128 may prove to be too long to be folded under the shortened table top 116 for storage in which event the legs themselves may be made foldable along central horizontal fold lines and held by suitable bracket means in the usable or extended condition.

Figure 13:
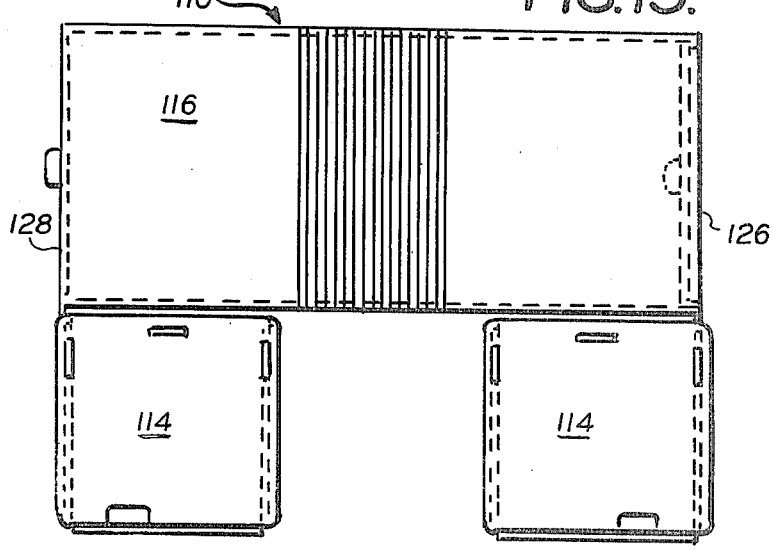
FIG. 13 is a top plan view of a modified combined collapsible table and seat assembly embodying the invention.

Alternatively, the arrangement of FIG. 13 may be modified to the construction of FIG. 14 wherein the seats 114 are diagonally arranged relative to the non-foldable table top 116, the remainder of the construction being essentially identical to FIG. 13 and to FIG. 1. In yet another alternative, not illustrated, two seats 114 may be in direct opposition in which event the table top 116 would have half the width shown in FIG. 14. Again, in such a construction, the legs 126 and 128 may prove too long to be folded under a shortened table top 116 in which event they may be made foldable along horizontal fold lines as previously described.

Yet another modification of the assembly 10 is shown in FIG. 15 and is indicated by the reference character 210. This construction is essentially identical to the construction 10 of FIG. 1 save for the fact that the table 12 is significantly wider than the table of FIG. 1 in order to accommodate three seat positions at each end of the table. This is accomplished by using two seats 214 each of which is a single seat and then by employing a double seat arrangement **214*a* attached to each of the other legs 226 and 228 of the table 210. The seats 214*a* may be constructed essentially identically to the seats 214 save for the fact that the middle plates 248 are twice as long as the end plates 246 and 250 as shown in FIG. 15, or, alternatively, the center wall plates 248 and the top plates 260 may be foldable along their center lines to reduce them to the size of the end wall plates 246 and 250**.

Figure 16:
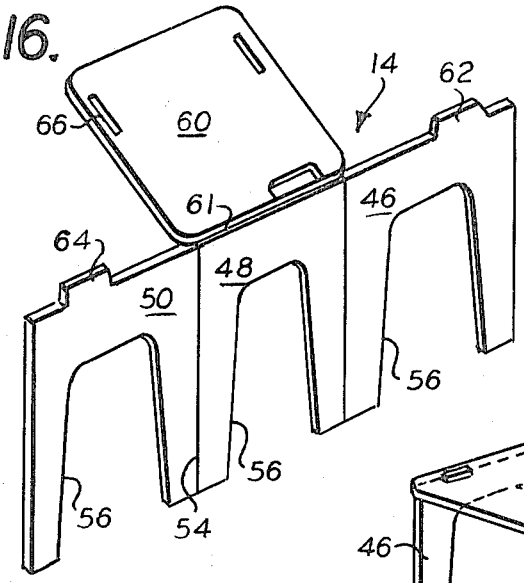
FIG. 16 is a perspective view of a collapsible seat embodying the present invention, said seat being in partially knocked-down or collapsed condition.
Figure 17:
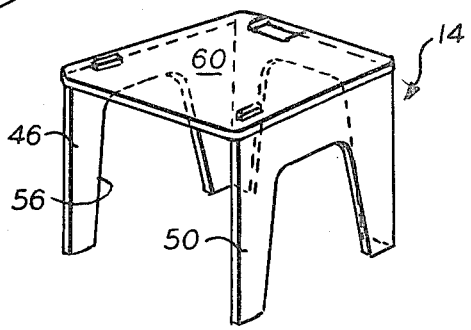
FIG. 17 is a perspective view of the seat of FIG. 16 but in fully erected condition.
Figure 18:
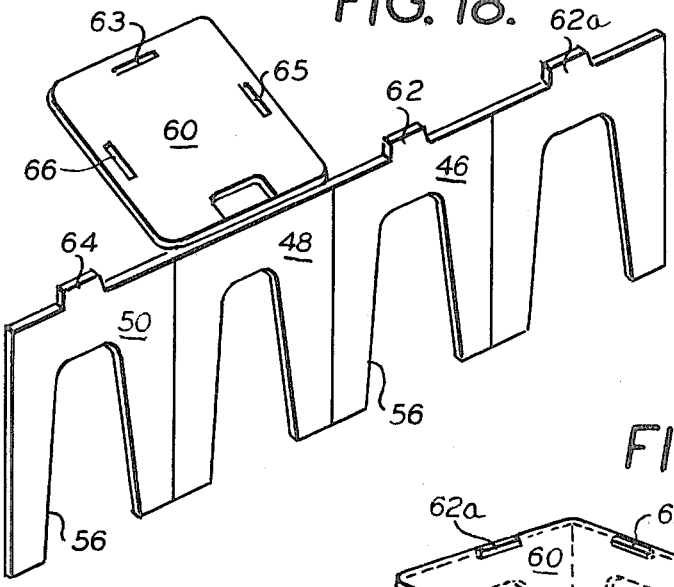
FIG. 18 is a view similar to FIG. 16 showing a modofied form of collapsible seat embodying the present invention.
Figure 19:
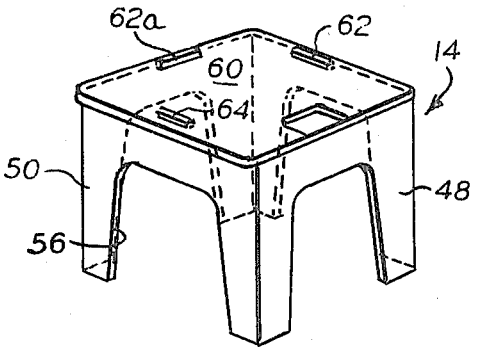
FIG. 19 is a view similar to FIG. 17 showing the FIG. 18 embodiment in fully constructed condition.

Referring now to FIGS. 16–19, it will be recognized that the collapsible seats of the assemblies 10, 110 and 210 in the several variations hereinbefore described may be employed by themselves as collapsible stools, or ottomans. These are shown in FIGS. 16–19. Referring first to FIGS. 16 and 17, these seats are identical in construction to the seats 14 and are therefore similarly numbered. The only difference between the structure of FIGS. 16 and 17 and the structure of, for example, FIG. 1, is that none of the plates is pivotally connected to a leg 26 or 28, the seat being free standing. In FIGS. 18 and 19, a modified form of collapsible seat or stool is shown incorporating yet an additional wall plate, whereby to form a peripherally continuous supporting wall, here shown as square, although other forms may be employed for supporting the top seat plate 60 of the embodiment of FIGS. 18 and 19. Apart from this difference, the mode of connection of the tops of the wall plates to the seat plates 60 may be any known releasable connection, and the protruberances 62, 64 and **62*a* and the corresponding slots 65, 66 and 63** are preferred.

Figure 21:
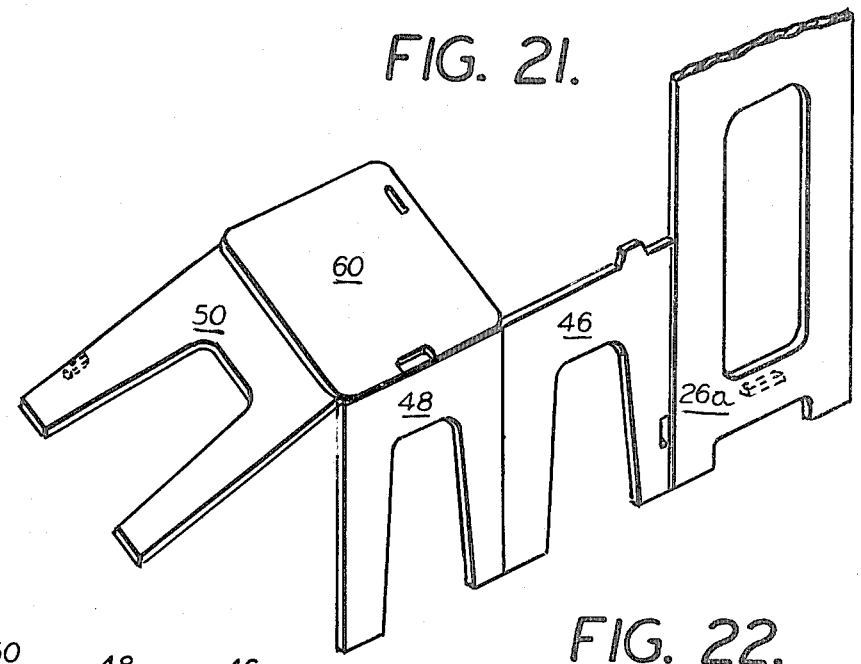
FIG. 21 is a fragmentary perspective view showing a modified form of seat construction in combination with a table leg embodying the present invention.

It has previously been suggested in this description that the arrangement of the four plates making up the seats 14 of the FIG. 1 embodiment need not be in the described arrangement but could be modified without departing from this invention. Thus, for example, referring to FIG. 21, rather than having the plate 50 pivotally mounted along the vertical edge to the plate 48, as shown in FIGS. 1 and 9 the plate 50 could instead, be pivotally mounted on the edge of the top plate 60. This would not significantly adversely effect the construction or operation of the table and is an embodiment well within the contemplation of this invention. Clearly, the plate 46 could be pivotally mounted to its adjacent leg **26*a* as described with regard to FIG. 1 or the plate 46 could be free of such leg to help define an individual collapsible stool of the type shown in FIGS. 16–19. Other arrangements of the four plates 46, 48 50 and 60** will readily suggest themselves to anyone skilled in the art. Any of these arrangements which ultimately yield a three-sided vertical supporting wall with a top structure overlying said wall, all of the plates being pivotally mounted are acceptable.

Figure 22:
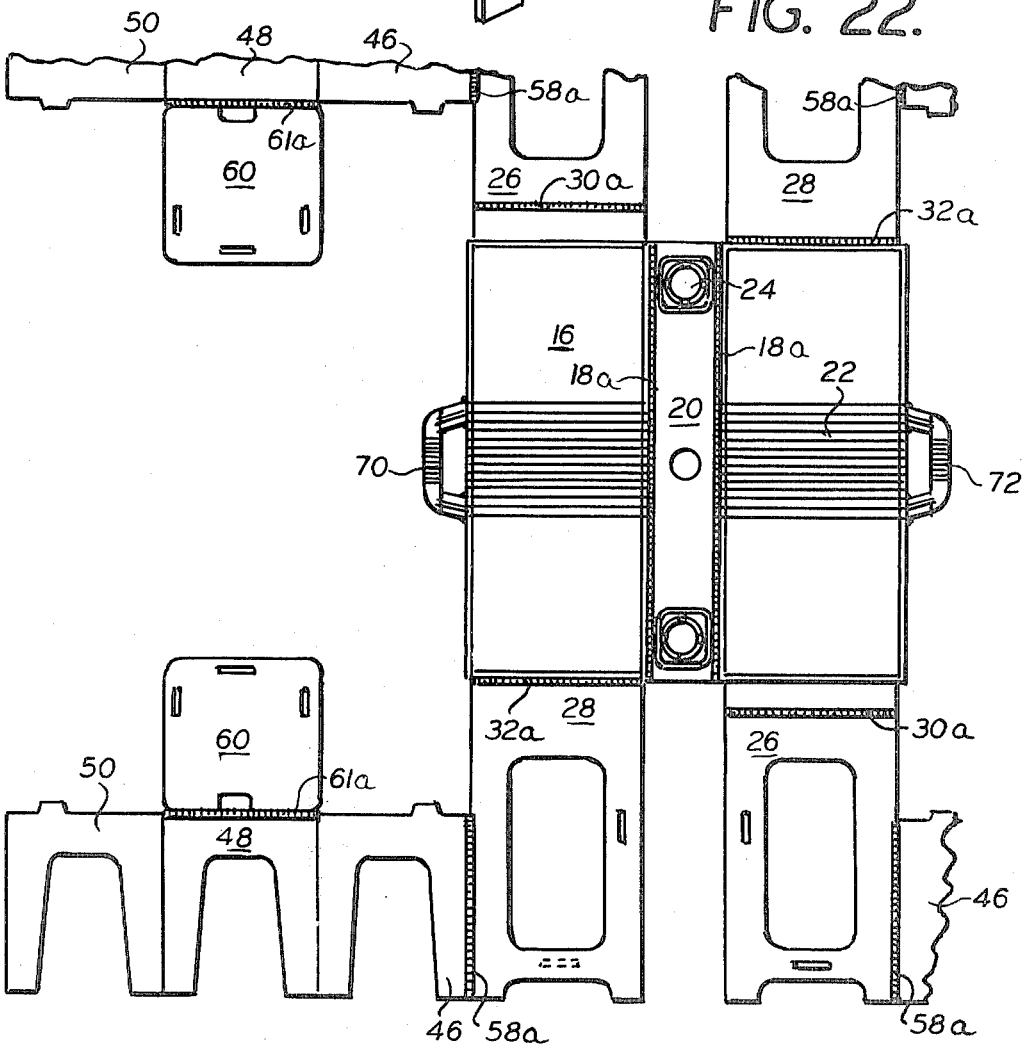
FIG. 22 is a view similar to FIG. 20 but showing a modified form of construction.

Likewise, with reference to FIG. 22, a modification is shown wherein a number of mechanical hinges such as piano hinges are employed in substitution of the integral hinges of the FIG. 1 embodiment. Thus, in lieu of the integral hinge of fold line 30, a piano hinge **30*a* is shown in FIG. 22 and likewise in lieu of the integral hinges 32 between the table top and the legs 28 a mechanical hinge such as a piano hinge 32*a* is shown at each such location. Likewise, mechanical hinges are shown between the legs and their adjacent seat-forming plate 46 which hinges are designated by the reference numeral 58*a* and a mechanical hinge is also substituted for the integral hinge between the wall-forming seat plate 46 and the seat top 60, said hinge being designated by the reference numeral 61*a*. While FIG. 22 does not show a preferred embodiment, it does illustrate the capability for breaking down the units of construction of the assemblies 10, 110 and 210** into various components for separate manufacture which may thereafter be joined by mechanical means to form the assemblies of this invention.

All of the various assemblies hereinbefore described have a variety of potential uses, such as for outdoor picnics, uses in institutions and schools and in the home. Some of the assemblies are believed to have especially desirable uses in one environment or the other, although clearly, each may be employed for any of such environments. Thus, for example, the FIG. 1 and FIG. 15 embodiments are believed to be clearly desirable as portable picnic tables for motorists driving along the country side since these devices 10 and 210 are readily storable in the trunks of most vehicles and easily set up along the roadside for picnicking. However, it will be obvious that such assemblies may be employed in institutional or home environments as well. The FIG. 13 embodiment on the other hand is believed to be especially desirable for institutional and home use. Thus, for example, the FIG. 13 embodiment would be especially useful in institutions having large open spaces such as gymnasiums when it is desired to convert such spaces into auditoriums, examination rooms or the like. Similarly, the FIG. 13 embodiment would be particularly desirable for use in a child's room in a home where the assembly 110 could be readily erected and collapsed according to the needs of the child. However, it will be apparent that the FIG. 13 embodiment would have many outdoor applications such as for travelers, backyard uses and the like.

In a similar manner, the FIG. 14 embodiment is perceived as one of special utilization in institutions, especially educational institutions, wherein it is desired to convert a large open space such as a gymnasium into an examination room. Such conversion can be readily effected by employing the FIG. 14 embodiment of the present invention and the seating arrangment is especially devised to reduce the likelihood or potential for unauthorized communication between students.

Of course, the collapsible stools or ottomans of FIGS. 16–19 have a myriad of uses in homes, businesses, schools and other institutions both indoors and outdoors. The use of the stools 14 as extra chairs at a home party, or to convert an open space into an auditorium, or as an ottoman or the like, will be obvious to anyone. Moreover, the stools 14 of FIGS. 16–19 readily fold into very compact spaces for storage and are extremely light weight so that they may be conveniently erected and collapsed.

Figure 23:
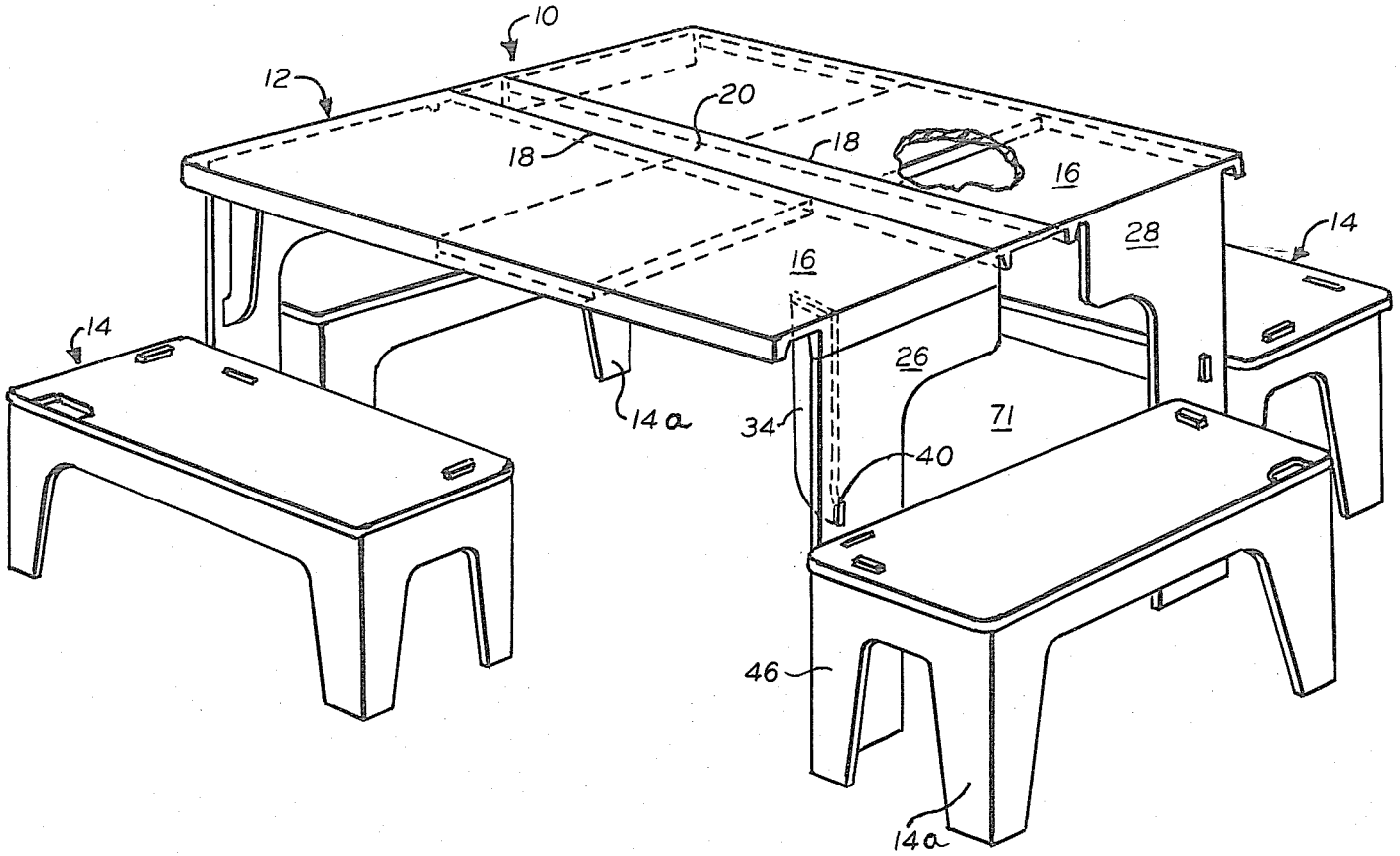

One modified form of the present invention, that shown in FIG. 23, has been especially designed for a particular application, although it will be apparent that it has many other uses as well. Specifically, the FIG. 23 modification of the FIG. 1 embodiment has been designed especially for use as a card table, such as a bridge table. The structure of the assembly 10 of FIG. 23 may be in all respects identical to the FIG. 1 structure save for the differences hereinafter noted. First, the legs 26 and 28, rather than being rectangular plate-like members with cutouts, are more or less L-shaped in order to define a relatively large central opening 71 to provide leg room for a player at each of the sides of the table. To accommodate this change in leg configuration, the braces 34 are moved closer to the ends of the table top portions 16 so that they will fit into slots 40 in the legs along the outer edges thereof. In addition to the changes in the legs 26 and 28 and the location of the braces 34, the other major modification of the FIG. 1 embodiment represented by the FIG. 23 embodiment is that rather than two collapsible seats 14 being located along each end of the table as in FIG. 1, there is only one seat 14 located at each end and there are seats 14 located along each side. This would be true not only for the seat 14*a* but for the seat 14 located diagonally thereof in FIG. 23 embodiment. Lastly, the seats 14 of the FIG. 23 embodiment are preferably not square as in the FIG. 1 embodiment but, instead, are elongated rectangles in order to permit the user to sit closer to the center of the side or end of the table in the fashion normally employed by card players such as bridge players. Apart from these modifications the construction of the FIG. 23 assembly 10 is in all respects identical to FIG. 1.

Of course, while the FIG. 23 embodiment is described in connection with a card table and chairs, it will be obvious to anyone that it has numerous other uses. Thus, for example, it can provide an excellent collapsible table for small meetings and the like or for work tables in schools, especially in the lower grades where children tend to sit in small groups around the same table. In such an application, the classroom can be readily converted into an unobstructed play area by rapidly collapsing the FIG. 23 embodiments to clear the room.

From the foregoing, it will be seen that the collapsible combined table and seat assemblies of the present invention have numerous advantages not present in the prior art. First of all, they may be made wholly of plastic such as polypropylene, which renders them light weight. Since the assemblies can be made wholly of plastic, they are capable of being formed in one operation as by injection molding (of course the braces 34 must be added separately after such integral formation). Such all plastic embodiments are very light weight. Such all plastic embodiments are also unitary, requiring no separate assembly of a multiplicity of separate components that are readily lost between uses. Alternatively, the various embodiments of the present invention may be constructed in separate unitary subassemblies as by molding or stamping and then joined into a unitary assembly as by plastic welding along integral hinges that are formed during the welding operation or by the use of mechanical hinges or the like. Thus, great flexibility in production techniques is available while still resulting in an assembly that is essentially all plastic, lightweight and very inexpensive to produce.

While I have shown and described the preferred embodiments of the present invention and have suggested numerous modifications thereof, other changes and modifications may be made therein within the scope of the appended claims without departing from the spirit and scope of this invention.

What is claimed is:

1. A collapsible combined table and confronting seat comprising:

a relatively rigid plate-like table top having a pair of ends and a pair of sides;

a pair of legs pivotally connected to said table top along different sides thereof for movement between collapsed positions in which said legs are in close confronting parallel relation to said table top and operative positions in which they depend from said table top along different sides; and a collapsible seat comprising four plates pivotally connected to one another for movement into an operative position wherein said four plates define a three-sided wall with a top, means for releasably holding said four plates in said operative position, said four plates being pivotal into a collapsed condition in which they lie in close confronting parallel relation with one another, one of the plates defining said wall being pivotally connected to one of said legs, so that said seat when collapsed is pivotally movable into close confronting parallel relation with said one leg.

2. The collapsible combined table and seat of claim 1, further comprising a brace for each leg movable into and out of an operative position in which said brace is connected to said table top and its associated leg.

3. The collapsible combined table and seat of claim 2, wherein each of said braces is pivotally connected to said table top and is detachably connected to said associated leg.

4. The collapsible combined table and seat of claim 1, wherein said four plates comprising said seat are arranged with the three plates forming the wall in side by side pivotal relation and the plate forming said top being pivotally connected to the upper edge of the middle of said three wall forming plates.

5. The collapsible combined table and seat of claim 4, wherein said means for releasably holding said plates in said operative position comprises an upwardly extending tab on the upper edge of said one wall forming plate and on the upper edge of the third wall forming plate remote therefrom, said plate forming said top having a pair of apertures for receiving said tabs when said plates are in said operative position.

6. The collapsible combined table and seat of claim 1, wherein said four plates are integrally formed from plastic and said pivotal connections are defined by thinned plastic sections.

7. The collapsible combined table and seat of claim 5, wherein said four plates are integrally formed from plastic and said pivotal connections are defined by thinned plastic sections.

8. The collapsible combined table and seat of claim 6, wherein said one leg to which said one plate is pivotally connected is formed of plastic integrally with said four plates, and the pivotal connection between said one plate and said leg is defined by a thinned plastic section.

9. The collapsible combined table and seal of claim 7, wherein said one leg to which said one plate is pivotally connected is formed of plastic integrally with said four plates, and the pivotal connection between said one plate and said leg is defined by a thinned plastic section.

10. The collapsible combined table and seat of claim 8, wherein the other leg and said table top are formed of said plastic integrally with said seat and said one leg, and the pivotal connections between said table top and said legs are defined by thinned plastic sections.

11. The collapsible combined table and seat of claim 9, wherein the other leg and said table top are formed of said plastic integrally with said seat and said one leg, and the pivotal connections between said table top and said legs are defined by thinned plastic sections.

12. The collapsible combined table and seat of claim 10, further comprising a brace for each leg movable into and out of an operative position in which said brace is connected to said table top and its associated leg.

13. The collapsible combined table and seat of claim 1, wherein the pivotal connection between one of said two legs and said table top is closely adjacent the bottom of said table top, and the pivotal connection between the other of said two legs and said table top is spaced from the bottom of said table top.

14. The collapsible combined table and seat of claim 1, further comprising a second substantially identical collapsible seat including four pivotally connected plates, one of said last-mentioned wall forming plates being pivotally connected to the other of said legs.

15. The collapsible combined table and seat of claim 14, wherein the four plates forming each separate collapsible seat are integrally formed from plastic, and the pivotal connections between said plates are defined by thinned plastic sections.

16. The collapsible combined table and seat of claim 1, wherein said table top is comprised of two relatively pivotal table top portions, and further comprising a second pair of legs pivotally connected to said table top along different sides thereof for movement between said collapsed position and said operative position, each pair of legs being connected to a different table top portion, and a second collapsible seat comprising four plates pivotally connected to one another for movement into an operative position wherein said four plates define a three-sided wall with a top, means for releasably holding said four plates in said operative position, said four plates being pivotal into a collapsed condition in which they lie in close confronting parallel relation with one another, one of the plates defining said wall in said second seat being pivotally connected to one of the legs in said second pair of legs so that said seat when collapsed is pivotally movable into close confronting parallel relation with said one leg in said second pair of legs.

17. The collapsible combined table and seat of claim 16, further comprising a brace for each leg movable into and out of an operative position in which said brace is connected to said table top and its associated leg.

18. The collapsible combined table and seat of claim 17, wherein the four plates comprising each of said seats are arranged with the three plates forming the wall being in side by side pivotal relation and the plate forming said top being pivotally connected to the upper edge of the middle of said three wall forming plates.

19. The collapsible combined table and seat of claim 18, wherein said means for releasably holding said plates in said operative position in each of said seats comprises an upwardly extending tab on the upper edge of said one wall forming plate and on the upper edge of the third wall forming plate remote therefrom, said plate forming said top having a pair of apertures for receiving said tabs when said plates are in said operative position.

20. The collapsible combined table and seat of claim 16, wherein the four plates forming each of said seats are integrally formed from plastic and said pivotal connections are defined by thinned plastic sections.

21. The collapsible combined table and seat of claim 20, wherein said one leg in each pair of legs to which said one plate is pivotally connected is formed of plastic integrally with said four plates, and the pivotal connection between said one plate and said leg is defined by a thinned plastic section.

22. The collapsible combined table and seat of claim 21, wherein all four legs in said two pairs of legs and said table top are formed of plastic integrally with said seats, and the pivotal connections between said legs and said table top are defined by thinned plastic sections.

23. The collapsible combined table and seat of claim 16, further comprising third and fourth collapsible seats substantially identical to the first and second collapsible seats and including four pivotally connected plates, one of the wall forming plates in each of said third and fourth seats being pivotally connected to the other legs in each of said two pairs of legs.

24. The collapsible combined table and seat of claim 23, wherein the pivotal connection between one of said two legs in each pair of legs and said table top is closely adjacent the bottom of said table top, and the pivotal connection between the other of said two legs in each pair of legs and said table top is spaced from the bottom of said table top.

25. The collapsible combined table and seat of claim 16, wherein said two table top portions are pivotally connected to one another by a central transverse spine member which is pivotally connected to each of said table top portions.

26. The collapsible combined table and seat of claim 25, further comprising third and fourth collapsible seats substantially identical to the first and second collapsible seats and including four pivotally connected plates, one of the wall forming plates in each of said third and fourth seats being pivotally connected to the other legs in each of said two pairs of legs.

27. The collapsible combined table and seat of claim 26, further comprising a brace for each leg movable into and out of an operative position in which said brace is connected to said table top and its associated leg.

28. The collapsible combined table and seat of claim 27, wherein each of said braces is pivotally connected to said table top and is detachably connectable to said associated leg.

29. The collapsible combined table and seat of claim 28, wherein the pivotal connection between one of said two legs in each pair of legs and said table top is closely adjacent the bottom of said table top, and the pivotal connection between the other of said two legs in each pair of legs and said table top is spaced from the bottom of said table top.

30. The collapsible combined table and seat of claim 29, wherein the four plates comprising each seat are integrally formed of plastic and said pivotal connections are defined by thinned plastic sections.

31. The collapsible combined table and seat of claim 30, wherein each of said legs is formed of plastic integrally with the seat pivoted thereon, and the pivotal connection between said one plate and said leg is defined by a thinned plastic section.

32. The collapsible combined table and seat of claim 31, wherein all four legs in said two pairs of legs and said table top are formed of plastic integrally with said seats, and the pivotal connections between said legs and said table top are defined by thinned plastic sections.

33. The collapsible combined table and seat of claim 14, wherein said seats are disposed along the same end of said table top.

34. The collapsible combined table and seat of claim 14, wherein said seats are disposed diagonally of said table top when said seats are in their operative positions.

35. The collapsible combined table and seat of claim 23, wherein two of said seats are disposed along one end of said table top and the other two seats are disposed along the other end of said table top when said seats are in their operative positions.

36. The collapsible combined table and seat of claim 35, wherein one seat on each end of said table top is twice as wide as the other seat along said end, whereby to accommodate six persons around said table.

37. The collapsible combined table and seat of claim 16, wherein each of said legs is a plate-like member disposed substantially in the plane of the side of the table along which it is disposed when said leg is in said operative position.

38. The collapsible combined table and seat of claim 16, wherein each of said legs is an inverted L-shaped member with the vertical portion thereof extending downward from the vicinity of a corner of said table top when said leg is in its operative position and the horizontal portion extends along the bottom of said table top and is operatively pivotally connected thereto, said first and second seats being disposed along the ends of said table in their operative positons, and further comprising third and fourth collapsible seats comprising four plates pivotally connected to one another for movement into an operative position wherein said four plates define a three-sided wall with a top, means for releasably holding said four plates in said operative position, said four plates being pivotal into a collapsed condition in which they lie in close confronting parallel relation with one another, one of the plates defining said walls, of each of said third and fourth seats being pivotally connected to the other leg in each of said pairs of legs for pivotal movement between an operative seat position along the side of said table and an inoperative position in which said collapsed seat is in close confronting parallel relation with the leg to which it is pivotally connected.

* * * * *